US011608257B2

(12) United States Patent
Clüsserath

(10) Patent No.: US 11,608,257 B2
(45) Date of Patent: Mar. 21, 2023

(54) METHOD FOR FILLING CONTAINERS WITH A LIQUID FILLING MATERIAL

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/599,777

(22) PCT Filed: Mar. 26, 2020

(86) PCT No.: PCT/EP2020/058525
§ 371 (c)(1),
(2) Date: Sep. 29, 2021

(87) PCT Pub. No.: WO2020/201001
PCT Pub. Date: Oct. 8, 2020

(65) Prior Publication Data

US 2022/0127124 A1 Apr. 28, 2022

(30) Foreign Application Priority Data

Apr. 4, 2019 (DE) ..... 10 2019 108 829.1

(51) Int. Cl.
*B67C 3/10* (2006.01)
*B67C 3/00* (2006.01)
(Continued)

(52) U.S. Cl.
CPC ..... *B67C 3/10* (2013.01); *B65B 3/06* (2013.01); *B67C 3/007* (2013.01); *B67C 3/12* (2013.01);
(Continued)

(58) Field of Classification Search
CPC ..... B67C 3/10; B67C 3/007; B67C 3/12; B67C 3/2614; B67C 3/2634; B67C 7/0277; B65B 3/04; B65B 3/06
See application file for complete search history.

(56) References Cited

U.S. PATENT DOCUMENTS 5,445,194 A * 8/1995 Clusserath ..... B67C 3/10 141/146
5,501,253 A * 3/1996 Weiss ..... B67C 3/2631 141/49
5,558,135 A * 9/1996 Kronseder ..... B67C 7/0073 141/39
(Continued)

FOREIGN PATENT DOCUMENTS

DE 4207829 A1 9/1993
DE 102013103192 A1 10/2014
(Continued)

OTHER PUBLICATIONS

International Search Report, PCT Application No. PCT/EP2020/058525, dated Jul. 24, 2020 (5 pages).

*Primary Examiner* — Nicolas A Arnett
(74) *Attorney, Agent, or Firm* — Occhiuti & Rohlicek LLP

(57) ABSTRACT

A filling method includes sealing a container against a filling element of a filling system, after the container has been sealed against the filling element and before beginning a filling phase, connecting the container to an annular vacuum duct, while the container is connected to the vacuum duct, carrying out an evacuation-and-flushing step in which the container is evacuated and flushed with flushing gas that comprises steam from an annular steam duct that carries pressurized steam, connecting the container to an annular pre-tensioning duct, pre-loading the container with inert gas from the pre-tensioning duct, filling the container with the liquid, and relieving pressure into the vacuum duct.

20 Claims, 9 Drawing Sheets

(51) Int. Cl.

| | |
|---|---|
| ***B67C 3/12*** | (2006.01) |
| ***B67C 3/26*** | (2006.01) |
| ***B67D 7/02*** | (2010.01) |
| ***B65B 3/06*** | (2006.01) |

(52) U.S. Cl.
CPC ..... *B67C 3/2614* (2013.01); *B67D 7/0277* (2013.01)

(56) References Cited

U.S. PATENT DOCUMENTS 5,564,481 A * 10/1996 Clusserath ..... B67C 3/10 141/39
5,634,500 A * 6/1997 Clusserath ..... B67C 3/286 141/49
6,470,922 B2 * 10/2002 Sindermann ..... B67C 3/10 141/37
9,862,584 B2 * 1/2018 Clüsserath ..... B08B 9/20
10,029,901 B2 * 7/2018 Clüsserath ..... B67C 3/2614
10,294,090 B2 * 5/2019 Clüsserath ..... B67C 3/2628
2001/0045242 A1 * 11/2001 Clusserath ..... B67C 3/007 141/144
2002/0139434 A1 * 10/2002 Meheen ..... B67C 3/10 141/59
2016/0025267 A1 * 1/2016 Clüsserath ..... B67C 3/2617 141/4
2019/0071295 A1 * 3/2019 Clüsserath ..... B67C 3/20

FOREIGN PATENT DOCUMENTS

DE 102013107256 A1 1/2015
DE 102016108502 A1 11/2017

* cited by examiner

METHOD FOR FILLING CONTAINERS WITH A LIQUID FILLING MATERIAL

RELATED APPLICATIONS

This is the U.S. national stage of international application PCT/EP2020/058525, filed on Mar. 26, 2020, which claims the benefit of the Apr. 4, 2019 priority date of German application DE 102019108829.1, the contents of which are herein incorporated by reference.

FIELD OF INVENTION

The invention relates to a method for filling containers with a liquid filling material.

BACKGROUND

When filling a container, it is known to evacuate the container, to flush it with an inert gas, and to then fill the container with liquid filling material.

It is also known to set the fill level by submerging a tube below the surface of the liquid and subjecting the container's head to high pressure, thus blowing out any excess liquid filling material until the surface drops to just below the level of the tube.

Among the known methods of filling are "free-jet filling" or "free jet complete filling." In this method, liquid filling material flows out of a liquid valve and into the container that is to be filled. In doing so, it flows as a free jet. The free jet's flow remains uninfluenced by such deflection elements as deflection screens, swirl bodies, or short or long filling pipes.

Free jet filling is either pressurized or unpressurized.

In unpressurized free-jet filling, the container is at ambient pressure. This is achieved by having its mouth at some distance from the filling element or, if the container's mouth is at the filling element, by having fluid communication between the atmosphere and the container's interior. This permits displaced gas in the container to escape into the atmosphere.

In pressurized free-jet filling, the container's mouth is sealed against the filling element and its interior pressure is raised by passing a pressurized inert gas, such as carbon dioxide, into the container. Alternatively, the container is evacuated. In either case, the container's internal pressure deviates from atmospheric pressure.

The use of an inert gas, and in particular, carbon dioxide gas, is costly and imposes a burden on the environment.

SUMMARY

An object of the present invention is that of providing a method for the filling of containers with a liquid filling material while reducing consumption of inert gas, thereby reducing costs and also reducing the environmental burden of the filling process.

According to a first aspect, the invention relates to a method for pressurized filling of containers with a liquid filling material, using a filling system with at least one filling element. According to the method, before the initiation of a filling phase, the container's interior is arranged in a sealed position at the filling element. The container is then evacuated in at least one evacuation-and-flushing phase by way of connection to a vacuum duct. The container's interior, which is also connected to the vacuum duct, is then flushed by a flushing gas. After the evacuation-and-flushing phase, the container's interior is preloaded with a pressurized inert gas, filled with liquid filling material, and, finally, relieved into a relief duct.

The present invention is characterised in particular by the fact that the container's interior is flushed with a flushing gas that includes steam taken from an annular duct that holds pressurized steam.

The use of steam as the flushing gas is more economical and also less environmentally detrimental than the use of an inert gas, such as carbon dioxide gas. In particular, the use of carbon dioxide, particularly if derived from fossil fuel, necessarily also incurs carbon dioxide emissions. In contrast, it is possible to generate steam using regenerative energy sources.

In some embodiments, the annular duct is subjected to water vapour as the flushing gas.

Some embodiments rely on a first control valve for the controlled switching of the annular duct subjected to steam to a first and second gas chamber that are isolated by a heat isolator.

In another embodiment, the evacuation and flushing phase to comprise an evacuation step, as well as a flushing step following at an interval of time, wherein, in an evacuation step, the inner chamber of the container is reduced to a pressure of between 0.1 bar to 0.3 bar absolute.

In some embodiments, in the flushing step following at an interval of time, steam is conveyed out of the annular duct, throttled by way of a constriction of the cross-section of a return gas pipe, in such a way that the pressure in the inner chamber of the container, in comparison with the end of the evacuation step, rises by 0.1 bar to 0.5 bar, preferably by 0.1 bar to 0.3 bar.

In other embodiments, due to the throttled flushing with steam from the annular duct during the flushing step, superheated steam is generated in the interior chamber of the container.

In some embodiments, during the flushing step, some 0.5 to 3.0 times the internal volume of the container is to be administered as the volume of steam.

In some embodiments, the steam is suctioned off to be condensed on the way to the annular duct. Among these are embodiments in which the steam is suctioned off by a vacuum pump and those in which the steam suctioned off condenses or is condensed on the way to the annular duct and/or on the way to the vacuum pump.

In still other embodiments, a relative pressure and/or absolute pressure inside a first and/or second gas chamber, and/or at each filling point in the container and/or inside a first and/or second annular duct, is monitored and/or controlled by means of at least one pressure sensor.

In some embodiments, at least the flushing step is pressure-controlled and/or pressure-regulated, with the engagement of at least one pressure sensor.

The expression "essentially" and/or "approximately" signifies in the meaning of the invention deviations from the exact value in each case by +/−10%, preferably by +/−5%, and/or deviations in the form of changes which are not of significance to the function.

Further embodiments, advantages, and possible applications of the invention also derive from the following description of exemplary embodiments and from the Figures. In this situation, all the features described and/or represented as images are in principle the object of the invention, individually or in any desired combination, regardless of their combination in the claims or reference to them. The contents of the claims are also deemed a constituent part of the description.

For the filling method according to the invention, which is described in detail hereinafter, the configuration as a free-jet filling method is not absolutely necessary. The filling method according to the invention can also be configured without further ado as a filling method with which the filling material is conveyed into the container which is to be filled by way of the bottle wall.

Accordingly, the free-jet filling method described heretofore is to be understood only as a possible embodiment and not as a mandatory feature of the present invention.

Although some aspects have been described in connection with a filling machine, it is understood that these aspects also represent a description of the corresponding filling method, such that a block element or a structural element of a device is also to be understood as a corresponding method step or as a feature of a method step. By analogy with this, aspects which have been described in connection with a method step or as a method step also represent a description of a corresponding block or detail or feature of a corresponding device. Some or all of the method steps can be carried out by a hardware apparatus (or with the use of a hardware apparatus), such as, for example, a microprocessor, a programmable computer, or an electronic circuit. With some exemplary embodiments, some or a plurality of the most important method steps can be carried out by such an apparatus.

BRIEF DESCRIPTION OF THE FIGURES

The invention is described in greater detail hereinafter on the basis of the figures by reference to exemplary embodiments, in which.

Identical reference numbers are used in the figures for those elements of the invention that are the same or that have the same effect. Moreover, for the sake of easier overview, only reference numbers are represented in the individual figures that are necessary for the description of the respective figure.

DETAILED DESCRIPTION

Figure 1:
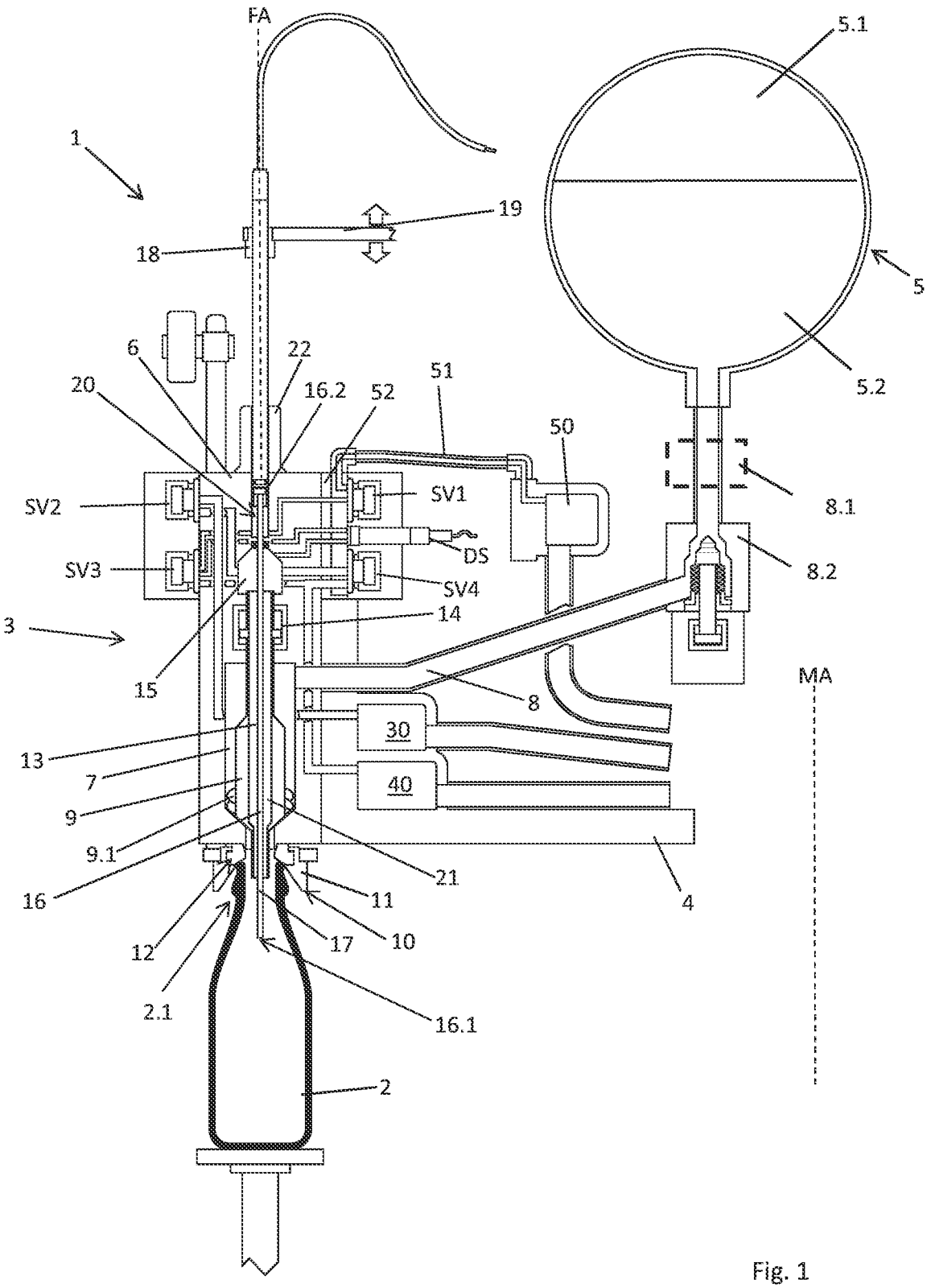
FIGS. 1-8 show an embodiment of a filling element.

FIG. 1 shows a filling system 1 that is part of a rotating filling machine for filling bottles 2 or similar containers with liquid filling material. Embodiments include those in which the filling system 1 is configured for free-jet filling, those in which it is configured for filling by way of the container wall, and those in which it is configured for a long pipe filling process.

An annular filling-material tank 5 located on the rotor 4 provides filling material to all the filling elements 3. During the filling operation, the tank 5 is partially filled with the filling material up to a predetermined level that is controlled during filling. A suitable line, which is not shown, conveys filling material to the filling tank 5 to replace filling material that has been used to fill containers, thereby maintaining the level in the tank 5. The fact that the tank is only partially filled is not a requirement. The principles described herein are applicable if the tank 5 is full or almost full.

As a result of being partially filled, there exists, within the tank 5, a gas-filled portion 5.1 and a liquid-filled portion 5.2 below the gas-filled portion 5.1. In those cases in which pressure filling is being carried out, the gas-filled portion 5.1 is pressurized to some filling pressure. The pressurizing gas is an inert gas, such as carbon dioxide.

In addition to the filling material tank 5, the rotor 4 includes three annular ducts that are common to all the filling elements 1.1 of the filling machine. These are: a pre-tensioning duct 30, which conveys inert gas under pressure, a vacuum duct 40, which is maintained at a vacuum, and a steam duct 50, which carries pressurized steam.

The vacuum duct 40 is typically maintained at between 0.05 bar and 0.25 bar to permit evacuation of containers 2 or the relieve container pressure.

The filling element 3 has a housing 6. Within this housing 6 is a liquid duct 7 that connects to the tank's liquid chamber 5.3 via a line 8. A flowmeter 8.1 on the line 8 measures volume rate of flow of liquid conveyed by the line 8 to the liquid duct 7.

A valve 8.2 at the connection between the liquid-filled portion 5.2 and the liquid duct 7 controls flow rate. In the illustrated embodiment, the valve 8.2 is a switching valve that has at least two switching positions, each corresponding to a different volumetric flow rate. In other embodiments, the valve 8.2 is a regulating valve that provides a continuously adjustable flow rate.

Within the liquid duct 7 is a liquid valve 9 for the controlled dispensing of the liquid filling material through an annular dispensing opening 10 that concentrically surrounds a vertical filling element axis FA. The dispensing opening 10 is formed on the underside of the filling element 3 at the end of the liquid duct 7 when the liquid valve 9 opens.

A centering tulip 11 with a seal 12 surrounds the dispensing opening 10. During filling, and in particular during pressurized filling and/or during the evacuation-and-flushing phase, the seal 12 is pressed against the container 2 at its container mouth 2.1.

The liquid valve 9 comprises a valve body 9.1 arranged in the liquid duct 7. The valve body 9.1 interacts with a valve seat that is formed on an inner surface of the liquid duct 7. In the illustrated embodiment, the valve body 9.1 is formed on a gas tube 13 that is arranged coaxially with the filling element axis FA. The gas tube 13 is open at both ends. In addition to conveying gas, the gas tube 13 also serves as a valve plunger for actuating the liquid valve 9. An actuator 14 coupled to the gas tube 13 causes it to move axially to either open or close the liquid valve 9.

During filling, the gas tube's lower end passes through the dispensing opening 11, projects past the underside of the housing and extends into the container 2. The gas tube's upper end extends into a first gas chamber 15. Since both ends are open, there exists a first gas duct 21 that extends between the container's interior and the first gas chamber 15.

The filling element 3 also comprises a return-gas pipe 16 that is coaxial with the filling element axis FA. The return-gas pipe 16 determines the filling height in the container 2. This return-gas pipe 16, sometimes referred to as a "TRINOX" pipe, extends through the gas tube 13 and projects with its lower end out of the lower open end of the gas tube 13.

The return-gas pipe 16, is arranged coaxially with the filling element axis FA and surrounded by the gas tube 13 at a spatial interval. During the filling operation, the end 16.1 of the return-gas pipe 16 extends into the head space of the container 2 and projects past the lower end of the gas tube 13.

The return-gas pipe 16 passes through the housing 6 and projects upwards beyond the housing 6. A carrier arm 18 of an adjustment device 19 engages the return-gas pipe 16 so as to be able to raise and lower the return-gas pipe 16 axially along the filling element axis FA. This permits adjustment of different filling heights in the bottle.

A second gas duct 17, which is formed in the return-gas pipe 16, opens into a second gas chamber 20 that is formed inside the housing 6. Radial openings 16.2 in the return-gas pipe 16 in the region of the second gas chamber 20 provide the fluid connection between the second gas duct 17 and the second gas chamber 20.

At the end of the filling process, the head space is exposed to considerable pressure. This pressure forces superfluous filling material back into the liquid tank 5 as long as the lower open end of the return-gas pipe 16 is below the level of the liquid filling material. As soon as the liquid filling material level drops below the level of the lower open end, this flow ceases. This provides a way to precisely control filling material level.

During the adjustment and setting of the fill level, there is a risk that axial movement of the return-gas pipe 16 will cause contaminants to reach critical regions or to reach the process side of the filling element 1. It is therefore useful to guide the return-gas pipe 16 through a lock passage 22 before it emerges above the housing 6. In the illustrated embodiment, the lock passage 22 is cylindrical extension of the housing 6 that is concentric with the filling element axis FA. The length of the lock passage 22 is at least equal to the maximum adjustment stroke so that the return-gas pipe 16 can be moved between its "maximum filling height" setting and its "minimum filling height" setting.

The filling element 3, 3*a* further comprises a valve block having first, second, third, and fourth control valves SV1, SV2, SV3, SV4. These are implemented either as controllable and/or regulatable diaphragm valves.

The first and second gas chambers 15, 20 are parts of the gas paths that are controlled by these control valves SV1, SV2, SV3, SV4. Through these gas paths, it is possible to connect the first and second gas ducts 17, 21 in a controlled manner to the gas-filled portion 5.1 of the annular tank 5, to the pretensioning and vacuum ducts 30, 40, and to the steam duct 50, which connects to the first control valve SV1 through a connecting line 51. A heat isolator 52 provides isolation between first control valve SV1 and the connecting line 51. This prevents the first and second gas chambers 15, 20 from being affected by the heat from the steam in the steam duct 50.

The filling element 3, 3*a* includes a pressure sensor DS for detecting pressure inside any combination of the gas chambers 15, 20 and the gas ducts 17, 21. The pressure is either relative pressure or absolute pressure or both. It is particularly useful for the pressure sensor DS to measure pressure inside the first gas chamber 15, which is in connection with the container's interior.

A special feature of the filling element 1.1 and of the method carried out with this filling element 1.1 is the manner in which the container's interior is flushed to expel ambient air from the container's interior while the container 2 is sealed against the filling element 1.1.

The procedure begins with evacuating the container's interior by connecting it to the vacuum duct 40. The process continues with flushing the container's interior with a flushing gas while it is still connected to the vacuum duct 40. This includes connecting the interior to the steam duct 50, which contains pressurized steam. As a result, the steam becomes a component of the flushing gas.

The container's interior is then preloaded with a pressurized inert gas by connecting it to the pre-tensioning duct 30. After having been preloaded, the container is then filled with the liquid filling material. Then, after having been filled, any excess pressure is relaxed to atmospheric pressure by connecting the container's interior to the vacuum duct 40.

To achieve an effective flushing of container's interior without consuming too much steam, it is useful for the evacuation-and-flushing phase to comprise an evacuation step and a flushing step that follows the evacuation step after an interval of time has lapsed.

Figure 2:
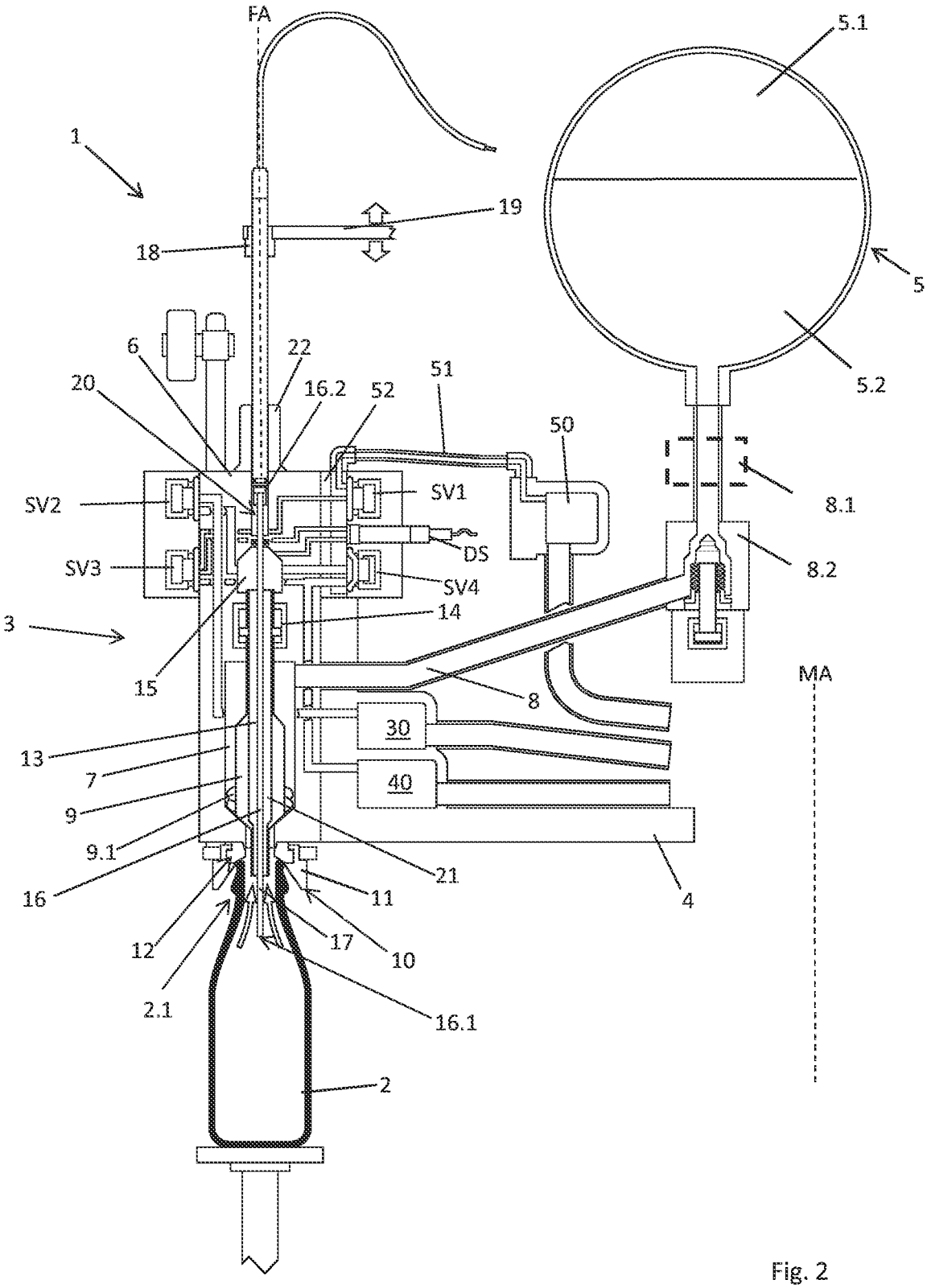

During the evacuation step, with the liquid valve 9 closed and the first, second, and third control valves SV1, SV2, and SV3 closed, the interior of the container 2 is evacuated by way of the opened fourth control valve SV4, via the first gas chamber 15 and the first gas duct 21. The container's interior is thus connected to a vacuum or to an extremely low pressure, which is in the range from 0.1-0.3 bar absolute, as shown in FIG. 2.

In the flushing step, which follows after an interval of time, with the fourth control valve SV4 still being open, the first control valve SV1 is opened. This permits steam to flow out of the steam duct 50. A constriction in the cross-section of the return-gas pipe 16 throttles the flow of steam somewhat. This constriction is formed by a reduction in diameter or by a regulating valve, in which case it is easily adjusted.

Figure 3:
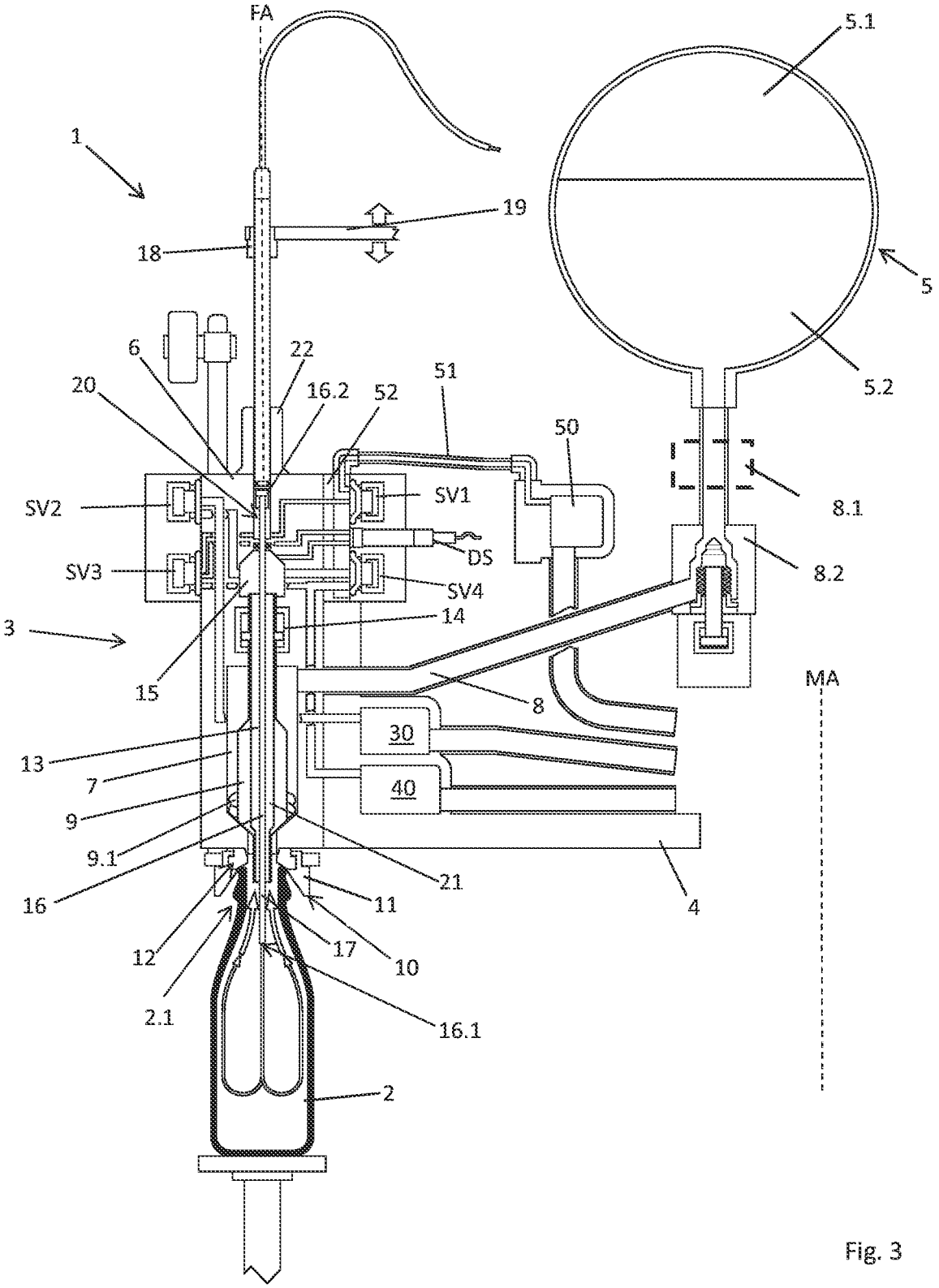
Figure 4:
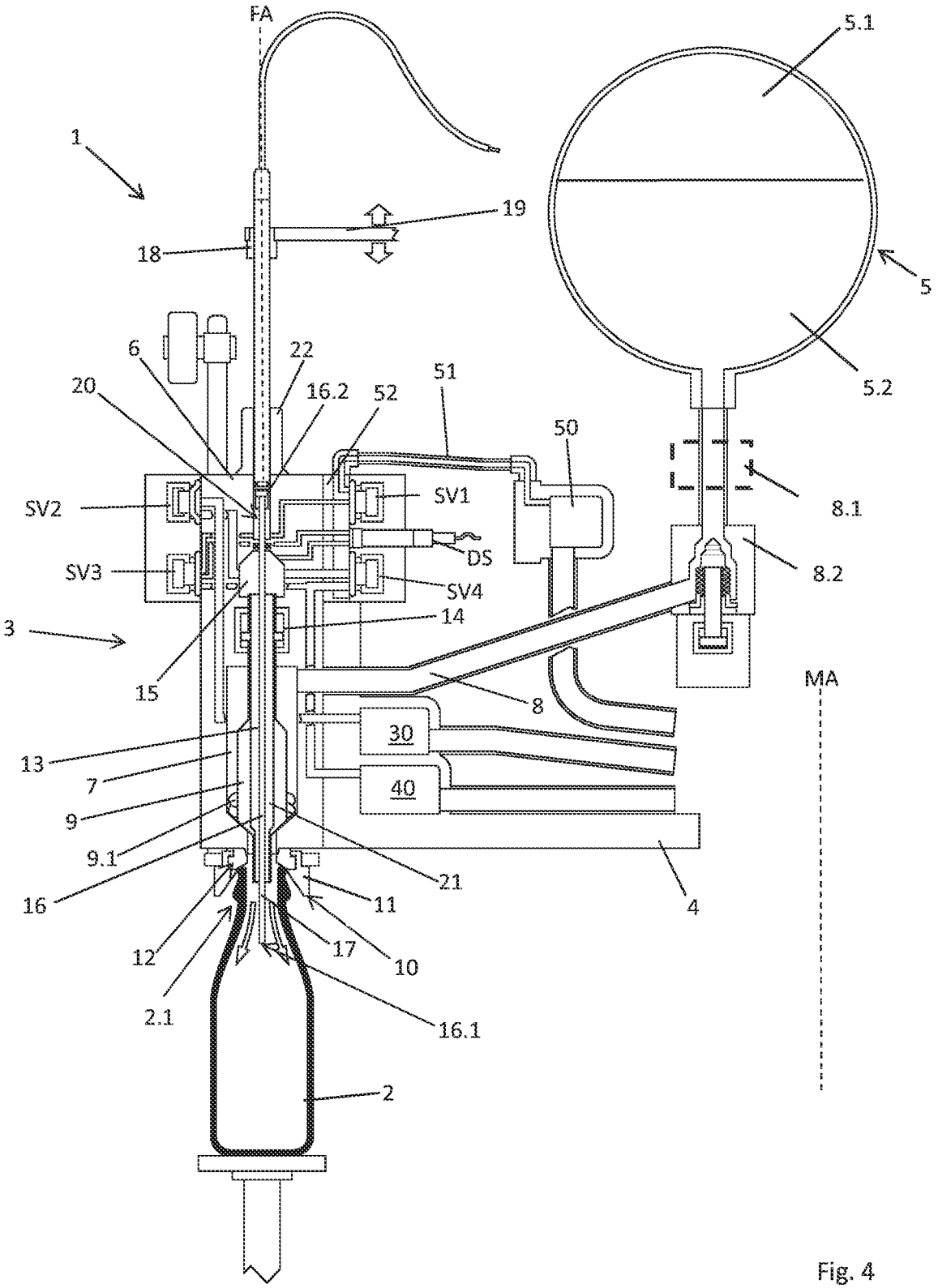
Figure 5:
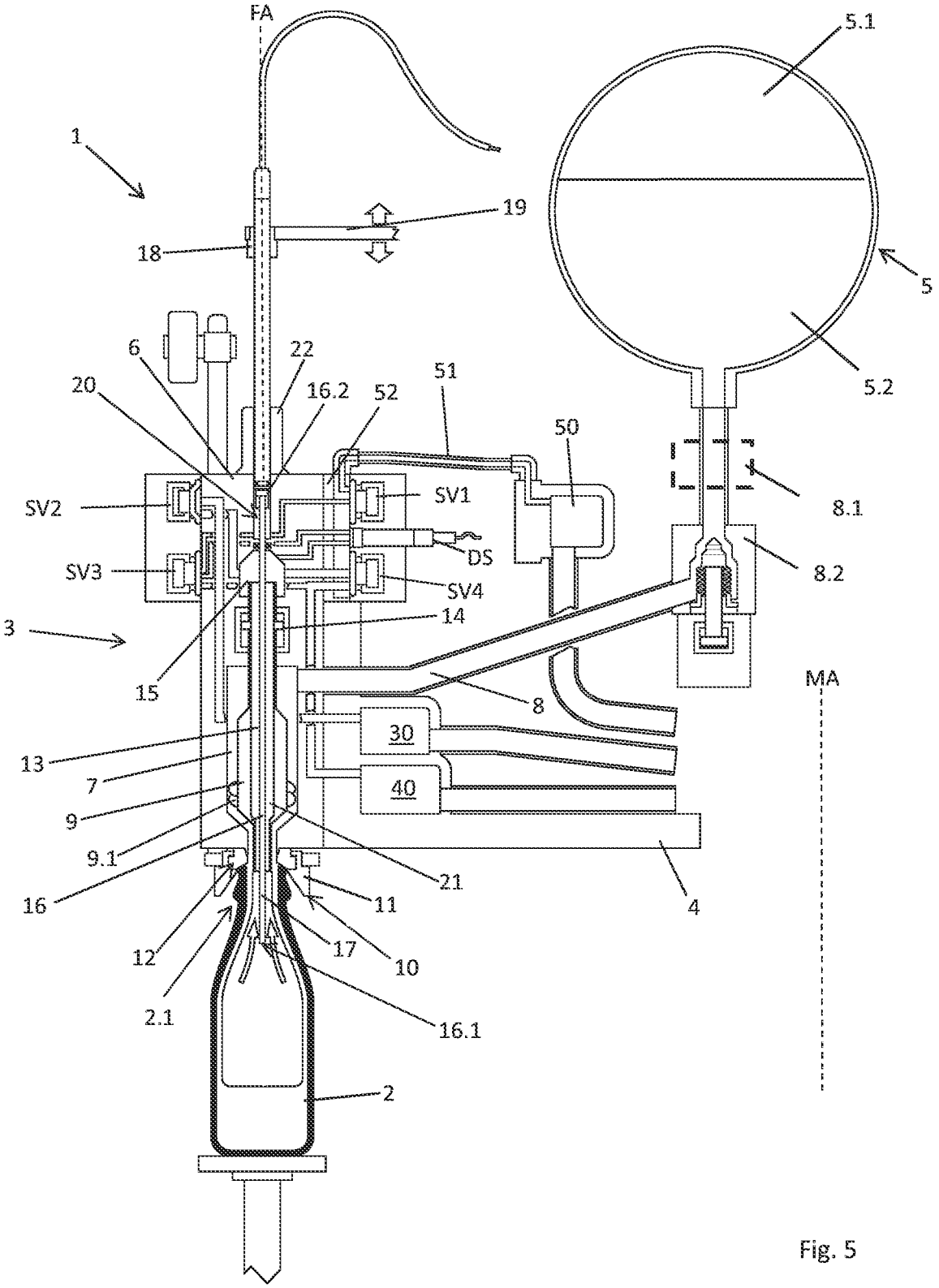
Figure 6:
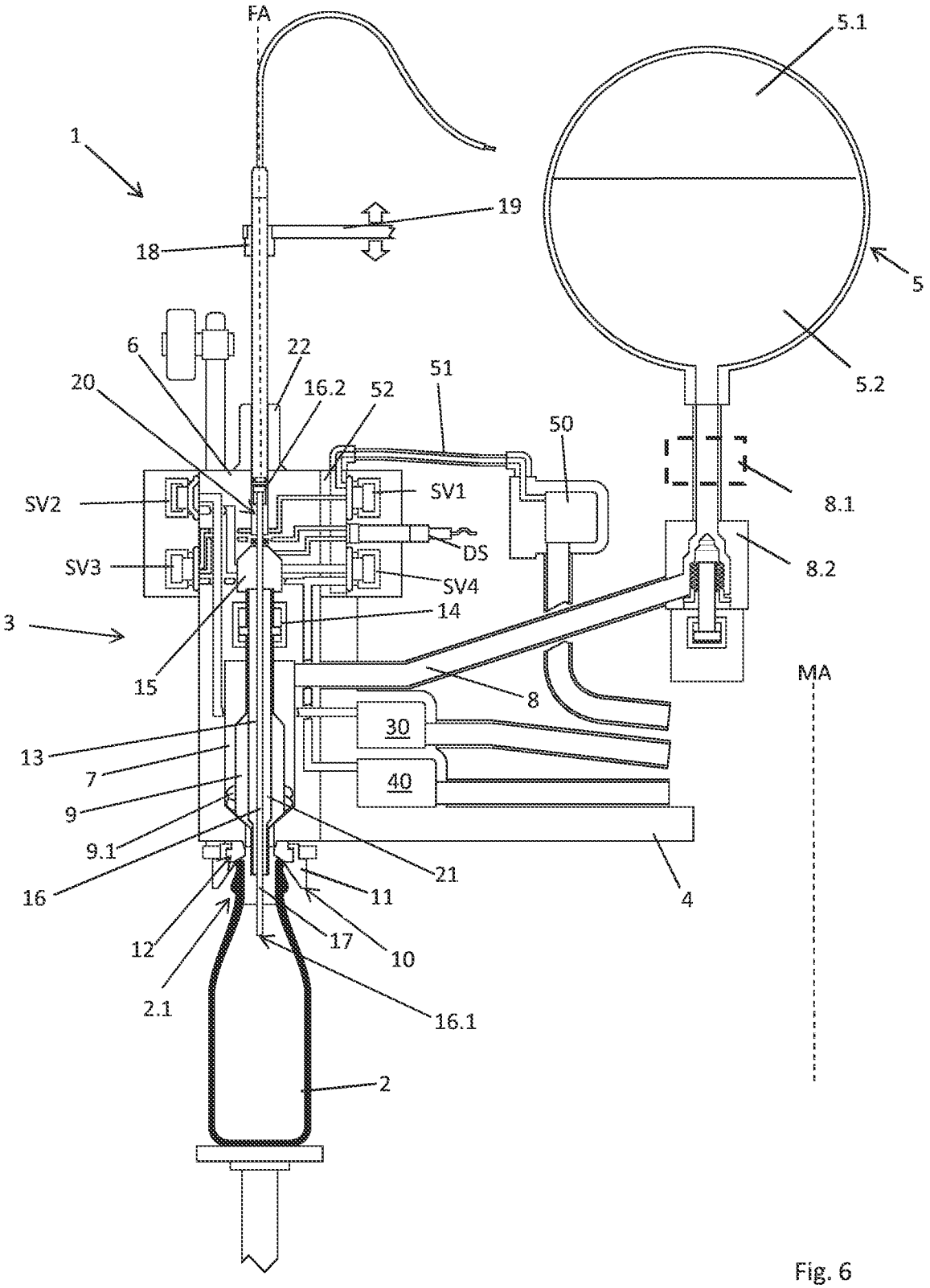

The steam is blown into the second gas chamber 20 and continues along the filling element axis, through the second gas duct 17, and downwards into the container's interior, where it serves as a flushing gas in the container's interior, as shown in FIG. 3.

The effect of the throttle can be set by the cross-section constriction, by the opening diameter, and/or by the number of openings 16.2. This throttled flushing with steam from the steam duct 50 provides superheated steam in the container's interior, which is connected to a vacuum. The return-gas pipe 16 extends deep into the container's interior. As a result, the steam that emerges from the return-gas pipe 16 manages to reach the container's base.

Because the fourth control valve SV4 is open, the steam and any air displaced by the flushing process escapes through the first gas duct 21, the first gas chamber 15, and through the opened fourth control valve SV4 to be conveyed away via vacuum duct 40.

In the treatment process, it is also possible for several evacuation and/or flushing phases to be switched or carried out as desired, alternating and following one another.

The cross-section constriction in the return-gas pipe 16 throttles the flow of steam to such an extent that the negative pressure set during the flushing in the container 2 at the end of the first evacuation step rises only slightly, for example by only about 0.1 bar to 0.2 bar. This means that, in the second flushing step, the flushing pressure can be set to be between about 0.15 bar and 0.45 bar.

The low pressure within the container's interior during this low-pressure flushing has the surprising result of promoting turbulence. Such turbulence assists in mixing residual air with the superheated steam.

It is particularly advantageous to meter the quantity of steam during the flushing step to correspond to approximately 0.5 to 3.0 times the container's volume. The quantity of steam thus metered corresponds to the quantity of flushing gas discharged into the vacuum duct 40. Doing so promotes a very rapid removal of residual air from container's interior using only a very small amount of steam.

The steam that is blown into the evacuated container 2 during flushing thus reduces the proportion of air in the container's interior. A significant portion of the steam that is sucked out through the vacuum duct 40 is condensed on its way to the vacuum pump and can simply be drained. This means that the vacuum pump has less work to do. As such, the use of steam and its subsequent condensation after flushing reduces the energy cost of operating the vacuum pump.

In a particularly advantageous practice, several filling elements 3 are connected to the vacuum duct 40 at the same time. Thus, during a simultaneous flushing step, a pressure compensation occurs between the connected interiors of the containers 2.

To promote more intensive flushing, it is useful to introduce the steam in the second method step continuously and without interruptions. However, other practices contemplate introducing the steam at intervals in discrete pulses.

In some practices, the flushing step is pressure regulated or pressure controlled using a measurement from the pressure sensor DS.

In some practices, the connection between the container's interior and the vacuum duct 40 is always open. This promotes a particularly intensive flushing of the container's interior.

In some embodiments, the return-gas pipe 16 includes an electrical probe for determining the filling height.

After the evacuation-and-flushing phase has been carried out, the container's interior is preloaded with an inert gas under pressure from the pre-tensioning duct 30. This is carried out by opening the second control valve SV2 and closing the first, third, and fourth control valves SV1, SV3, and SV4. This permits inert gas from the pre-tensioning duct 30 to flows via the first gas chamber 15 and the first gas duct 21 into the container's interior. The inert gas that flows into the container's interior thus raises the pressure within the container.

Following this, the actual filling phase takes place, in which the container 2 is filled with liquid filling material. During this filling phase, the container remains in a sealing position at the filling element 3, 3*a*.

Figure 7:
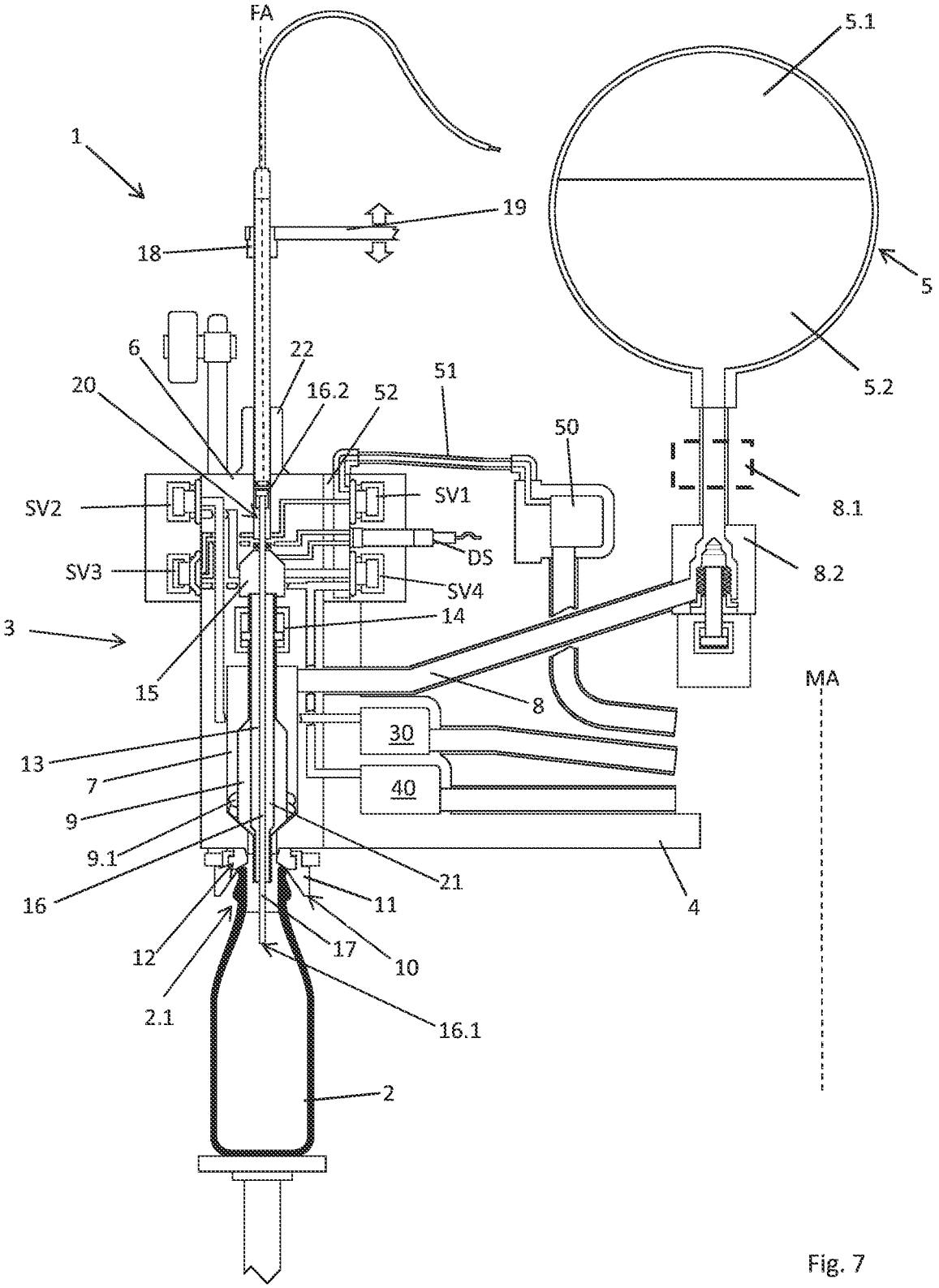
Figure 8:
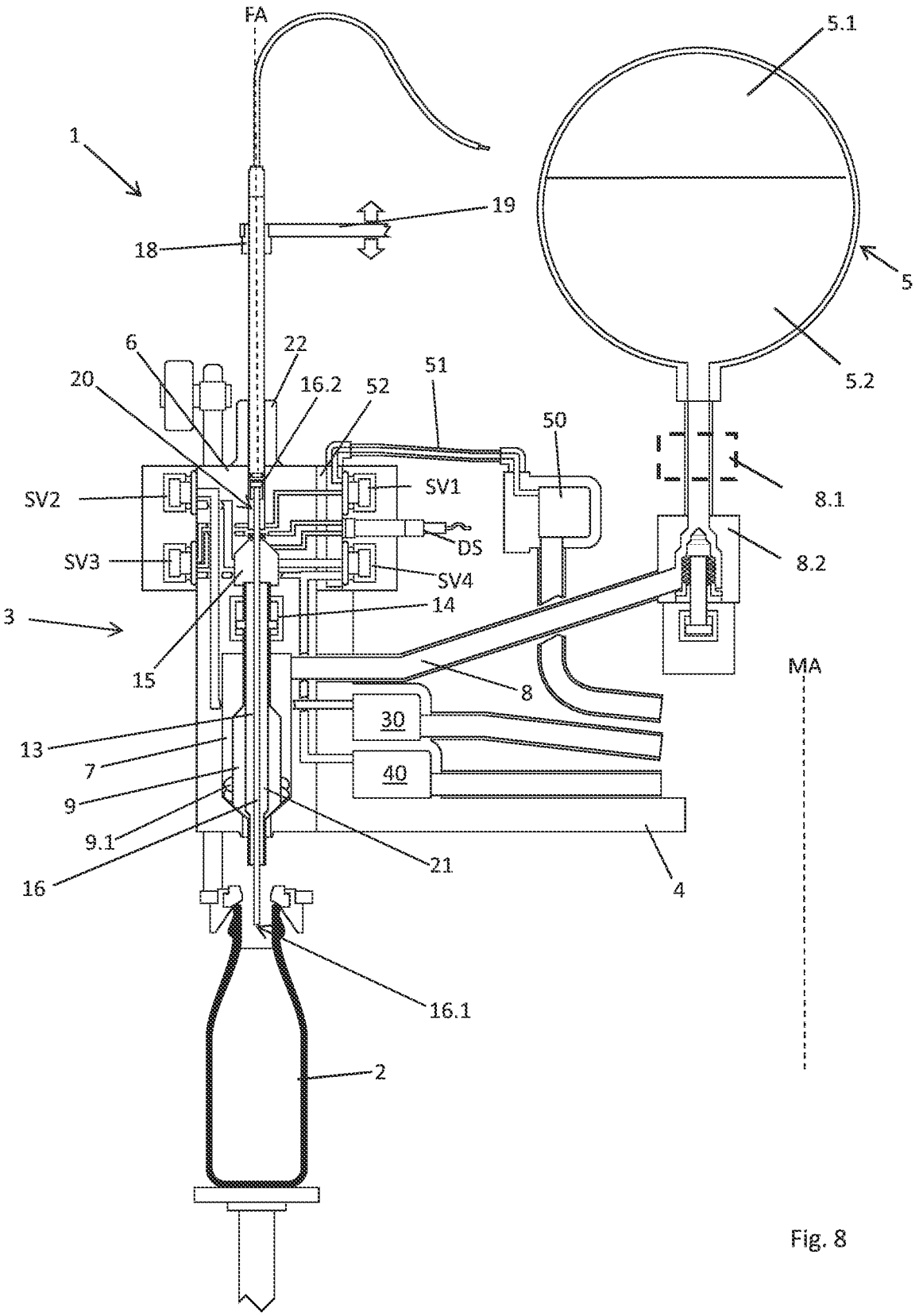

To relieve the filled container's head space, the third control valve SV3 opens, thus connecting the first gas duct 21 to the vacuum duct 40 via the first gas chamber 15. As a result, inert gas flows out of the head space and into the vacuum duct 40, as shown in FIG. 7. Following the pressure relief, the filled container 2 is lowered, as shown in FIG. 8.

In an alternative embodiment, the container's pressure is relieved as a separate operation that takes place using a separate relief duct formed on the filling machine.

Figure 9:
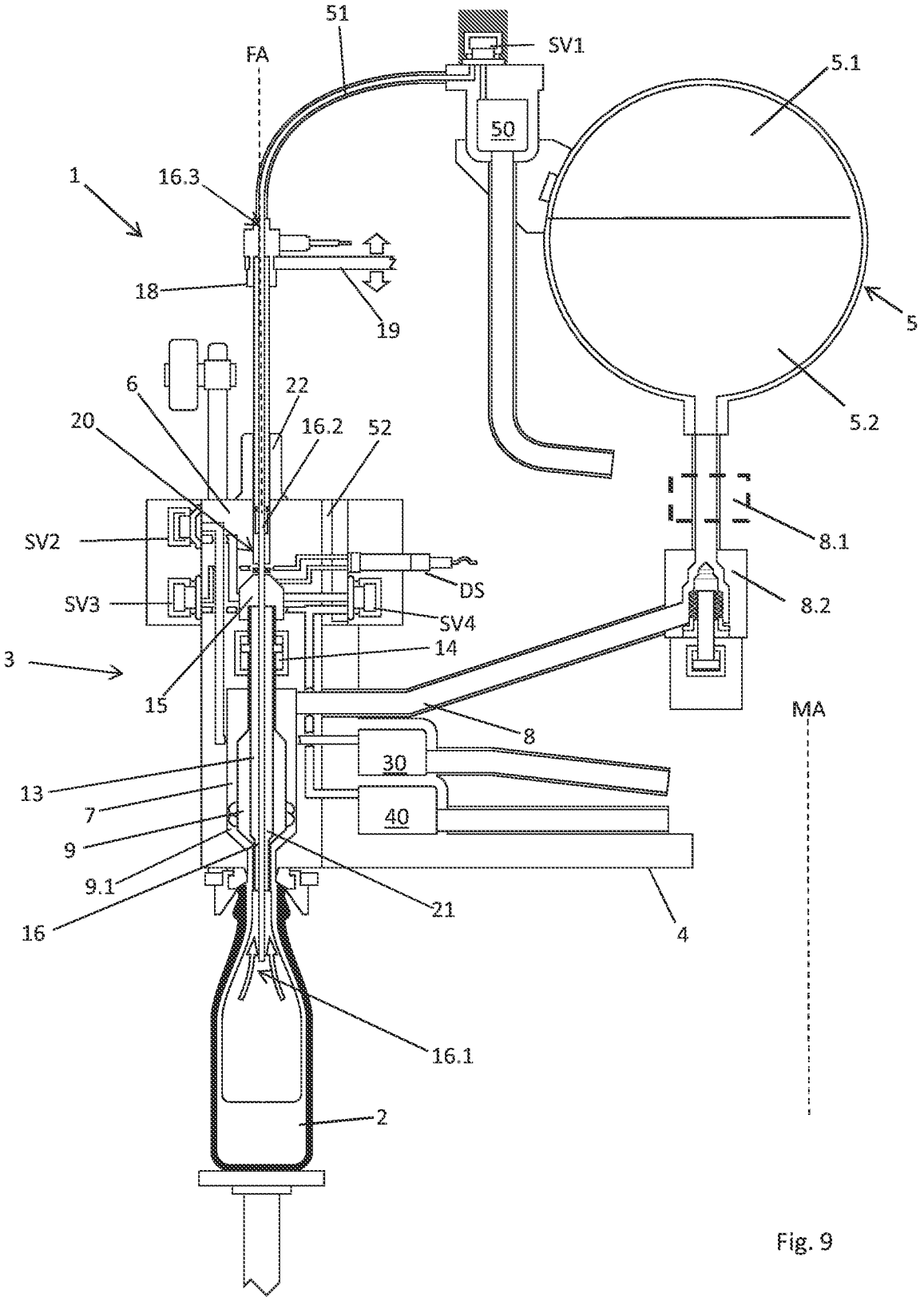
FIG. 9 shows another embodiment of a filling element.

FIG. 9 shows a further embodiment of a filling element 3*a* in which a return-gas pipe 16 is guided through the filling element's housing 6 and projects past an upper side of the housing 6. The return-gas pipe 16 is held there by its upper open end 16.3 on a carrier arm 18 of an adjustment device 19.

The adjustment device 19 is configured such as to raise and lower the carrier arm 18, including the return-gas pipe 16 held to it, axially along the filling element axis FA. Furthermore, the upper open end 16.3 is connected via the connection line 51 to the steam duct 50 which is pressurized by steam with the intermediate engagement of the first control valve SV1.

The invention has been described heretofore by way of exemplary embodiments. It is understood that a large number of modifications or derivations are possible, without thereby departing from the scope of protection of the invention defined by the claims.

Accordingly, substantial parts of the foregoing description or of the exemplary embodiments relate to a method for the pressurized filling of containers. The method according to the invention can of course also be used for pressureless filling, i.e. for filling under normal pressure or under ambient pressure, wherein filling materials are filled which are free of carbon dioxide or comparable pressure gases.

The claims are declared to be a constituent part of the description.

The invention claimed is:

1. A method of using a filling system to fill a container with a liquid, said method comprising sealing said container against a filling element of said filling system, after said container has been sealed against said filling element and before beginning a filling phase, connecting said container to an annular vacuum duct, while said container is connected to said vacuum duct, carrying out an evacuation-and-flushing step in which said container is evacuated and flushed with flushing gas that comprises steam from an annular steam duct that carries pressurized steam, connecting said container to an annular pre-tensioning duct, pre-loading said container with inert gas from said pre-tensioning duct, filling said container with said liquid, and relieving pressure into said vacuum duct, wherein said evacuation-and-flushing step comprises an evacuation step and a flushing step, wherein said evacuation step comprises lowering a pressure in said container's interior to between 0.1 bar and 0.3 bar absolute, wherein said flushing step comprises metering a quantity of steam while said container is being flushed, said quantity being between half of said container's volume and thrice said container's volume, and wherein said flushing step begins following a lapse of a time after completion of said evacuation step.

2. The method of claim 1, further comprising using water vapor in said flushing gas.

3. The method of claim 1, further comprising using a control valve and a heat isolator to isolate said steam duct from first and second gas chambers in said filling element.

4. The method of claim 1, wherein said flushing step comprises using a cross-section constriction of a return-gas pipe to throttle flow of steam that is conveyed out of said steam duct such that pressure in said container's interior rises over that prevailing in the container's interior upon completion of said evacuation step, and wherein said pressure rises by an amount that is between 0.1 bar and 0.5 bar.

5. The method of claim 1, wherein said flushing step comprises using a regulating valve provided in a return-gas pipe to throttle flow of steam that is conveyed out of said steam duct such that pressure in said container's interior rises over that prevailing in the container's interior upon completion of said evacuation step, and wherein said pressure rises by an amount that is between 0.1 bar and 0.3 bar.

6. The method of claim 1, further comprising generating superheated steam in said container's interior, wherein generating said superheated steam comprises throttling flow of steam from said steam duct while said container is being flushed.

7. The method of claim 1, further comprising causing steam that has been evacuated from said container to condense before reaching said vacuum duct.

8. The method of claim 1, further comprising causing steam that has been evacuated from said container to condense before reaching a vacuum pump connected to said vacuum duct.

9. The method of claim 1, further comprising using a pressure sensor to monitor pressures inside first and second gas chambers within said filling element and first and second gas ducts within said filling element and to control said pressures.

10. The method of claim 1, wherein said filling element comprises a gas chamber and a gas duct, said method further comprising using a pressure sensor to monitor pressures inside gas chamber and said gas duct and to control said pressures.

11. The method of claim 1, wherein said flushing step is regulated based on pressure measurements from a pressure sensor.

12. The method of claim 1, wherein said filling element is one of a plurality of filling elements of said filling system and wherein said annular pre-tensioning duct is common to all filling elements of said filling system.

13. The method of claim 1, wherein filling said container with said liquid comprises drawing said liquid from an annular tank that contains said liquid and an inert gas above said liquid.

14. The method of claim 1, wherein carrying out said evacuation-and-flushing step comprises passing said steam through a pipe that extends sufficiently deeply into said container's interior such that steam emerging therefrom reaches a base of said container.

15. The method of claim 1, wherein carrying out said evacuation-and-flushing step comprise connecting said container's interior to said steam duct such that said steam becomes a component of said flushing gas.

16. The method of claim 1, wherein metering a quantity of steam while said container is being flushed comprises metering a quantity that corresponds to a quantity of flushing gas discharged into said annular vacuum duct.

17. The method of claim 1, wherein said filling element is first filling element of said filling system, wherein said container is a first container, wherein said filling system comprises a second filling element that is filling a second container, wherein said flushing step is carried out simultaneously with a flushing step at said second filling element, thereby causing pressure compensation to occur between connected interiors of said first and second containers.

18. The method of claim 1, wherein metering said quantity of steam comprises introducing said steam continuously with no interruptions.

19. The method of claim 1, wherein metering said quantity of steam comprises introducing said steam at intervals in discrete pulses.

20. The method of claim 1, further comprising draining water from said vacuum duct, said water having resulted from condensation of steam used in said flushing step.

* * * * *